US008032950B2

(12) United States Patent
Leftenant

(10) Patent No.: US 8,032,950 B2
(45) Date of Patent: Oct. 11, 2011

(54) LOCKS DOWN

(76) Inventor: Deon D. Leftenant, Brentwood, NY (US)

( * ) Notice: Subject to any disclaimer, the term of this patent is extended or adjusted under 35 U.S.C. 154(b) by 100 days.

(21) Appl. No.: 12/489,423

(22) Filed: Jun. 22, 2009

(65) Prior Publication Data

US 2010/0043122 A1 Feb. 25, 2010

Related U.S. Application Data

(63) Continuation-in-part of application No. 11/906,975, filed on Oct. 5, 2007, now abandoned.

(60) Provisional application No. 60/832,270, filed on Jul. 21, 2006.

(51) Int. Cl.
*A42B 1/04* (2006.01)

(52) U.S. Cl. ..... 2/202; 2/207

(58) Field of Classification Search ..... 2/174, 202, 2/204, 207; 132/273, 277
See application file for complete search history.

(56) References Cited

U.S. PATENT DOCUMENTS

| | | | | |
|---|---|---|---|---|
| D135,323 | S | 12/1942 | Liberatore | |
| 2,730,722 | A * | 1/1956 | Colangelo | 2/202 |
| 3,076,972 | A * | 2/1963 | Prophet et al. | 2/174 |
| 3,983,580 | A * | 10/1976 | Zeiber | 2/174 |
| 5,566,689 | A * | 10/1996 | Yeater | 132/212 |
| 5,727,575 | A | 3/1998 | Rontal | |
| 5,878,756 | A | 3/1999 | Bilodeau | |
| D482,843 | S | 12/2003 | Burnett | |
| 6,735,783 | B2 | 5/2004 | Phillips | |
| 6,738,986 | B1 | 5/2004 | Martin | |
| 7,096,510 | B2 | 8/2006 | Yeadon | |
| 7,437,777 | B2 | 10/2008 | Marquardt | |
| 7,591,024 | B2 * | 9/2009 | Grey et al. | 2/204 |
| 2006/0288467 | A1 | 12/2006 | Jones | |

* cited by examiner

*Primary Examiner* — Katherine Moran
(74) *Attorney, Agent, or Firm* — Harold G. Furlow, Esq

(57) ABSTRACT

A head covering is described that is positioned on a head of a wearer to retain the wearer's hair in a desired position. The head covering comprises a hooded cap and an extension. The hooded cap includes a pair of ties and a set of straps. The hooded cap is secured to the head of the wearer using ties. The extension connects to the hooded cap on one end and includes an opposing distal end portion with a free terminal end. The extension includes a pouch and a flap. The pouch defines a first aperture in proximity to the hooded cap and a second aperture in proximity to the flap. A passageway is defined between the first aperture, the extension and the second aperture. The flap and pouch include connectors for the optional connection of the flap and pouch to secure the second aperture in a closed position. At least one strap is connected to the extension. The straps are constructed to secure the extension and hair together. The head covering has a first position wherein the head covering is passed along the hair of the wearer from a distal end of the wearer's hair to the wearer's head. The second position of the head covering includes the hooded cap positioned on the wearer's head and the hair of the wearer at least partially positioned in the passageway defined in the extension.

14 Claims, 19 Drawing Sheets

12

24
24
22
48
30
32
28
28
26

LOCKS DOWN

CROSS-REFERENCE TO RELATED APPLICATIONS

This continuation in part application claims priority to utility patent application Ser. No. 11/906,975 filed Oct. 5, 2007 now abandoned, provisional patent application No. 60/832,270 filed Jul. 21, 2006 and Document disclosure No. 603701 filed Jul. 19, 2006, the disclosures of which are incorporated by reference herein and made a part of this application.

BACKGROUND OF THE INVENTION

1. Field of the Invention

The present disclosure relates to heading covering products and their methods of application and in particular, to an apparatus and method for a head covering that can be selectively employed to retain and contain the hair of a wearer.

2. Description of the Related Art

There are many head coverings on the market today, the most popular being the du-rag. While this head covering is widely used, the du-rag is not designed to hold long hair in place, rather to lie over the hair. After an extensive patent search, we have found the following patents to be relative to the Locks Down disclosure. U.S. Pat. Nos. 7,096,510, 6,738,986, 6,735,783, 5,878,756, D135,323 and D482,843.

U.S. Pat. No. 7,096,510 to Yeadon (2004) teaches a head covering that has a three-sectioned hemispheric crown. The sections of the crown include a headband 6, securing ties 7, and a center section 3 that includes a flap extending over the neck 2. The flap extending over the neck 2 is an extension or pouch 8 form the back of the head down the neck. The pouch 8 received the long hair of the wearer. An elastic opening 10 secures the inner wall around the hair as shown in FIGS. 1-3 of the reference.

U.S. Pat. No. 6,738,986 to Martin (2004) teaches a head covering made from a single piece of material. A central top seam forms a hemispheric cap portion and a fold 36 and the securing of the edges 34 and 32 form a pouch portion. Tie members 38 and 40 are linear vertical strips of material that are integrally connected to and extend downward from the bottom front of the cap portion. Tie members 38 and 40 also have an inner edge formed from cut outs 55 (see col. 3, lines 40-51).

This head covering claims a tail compartment where there is a closure to store things in, it also claims that hair could be tucked into this compartment. This demonstrates that our method of application is inconsistent with and could not be used on this head covering. Also, this reference teaches the use of the head covering during underwater/aquatic uses such as swimming. In contrast, the present disclosure is a stylish fashion hair accessory.

U.S. Pat. No. 5,878,756 to Bilodeau (1999) teaches a cap with a hollow hemispherical configuration. The lower peripheral edge has a thin rectangular band 16 mounted thereon. Band 16 has a pair of free end 18 that extend from a rear extent of the cap, selectively tie and secure the cap to the head of the user. A hair sleeve 20 is an elongated strip 22 of flexible cloth that is connected to the cap. Hair sleeve 20 has four equally spaced pairs of rectangular tabs 24 that extend perpendicularly from the longitudinal side edges of the hair sleeve 20. Tubular sleeve 26 can thus receive and pass through the hair of the wearer. In contrast to the present disclosure, this head covering has a sleeve that ties around the long hair of the wearer and thus cannot employ the method of applying the head covering of the present disclosure.

U.S. Pat. No. D482,843 to Burnett (2003) shows triangular shaped head covering that is folded to define ties that can connect in the front or back of the head. A pouch is also shown that receives, or as claimed retains the wearer's hair. This head-covering patent claims the ornamental design for a scarf and headwear with packet for retaining hair.

SUMMARY

This disclosure relates to a head covering accessory product and the method of applying and wearing the head covering. The head covering covers the top, sides and back of the head. Ties on opposing sides of the head-covering tie behind the head by the nap of the wearer's neck and fix the covering on the head of the wearer. The inside of the covering includes a pocket or passageway that can contain or pass the hair through the head covering. The head covering is preferably made from approximately seven pieces of cloth.

I have invented as defined in this disclosure herein a novel head covering. In conjunction with this disclosure, I have discovered a method of applying said head covering to the wearer's head. This method not only makes it a simple process to put this head covering on the wearers head, but also provides a method that leaves the hair undisturbed. This method will keep the hair in the same condition as it was before this head covering is applied. The head covering itself in turn keeps the hair in place, while keeping other elements out of the wearer's hair. Once the head covering is removed, the wearer finds that their hair is still in the same condition it was before head covering was applied.

The method of applying this head covering is unique, as no other head covering is designed to employ the presently described method of application and wearing. The head covering has an opening in the bottom that you can slip your hand into, grab the hair and pull the hair through the passageway of the head covering. This process advantageously simplifies the process of using this head covering and keeps the pre-existing hair style of the wearer from being disturbed.

My head covering has many uses. Any suitable fabric can be used to make this product. With the different fabrics come different uses. I have used terry cloth fabric to make this product. The terry cloth fabric allows the wearer to use this head covering after washing their hair or after swimming, providing a new method of drying hair. As many people use a towel to wrap around their head this product can do away with the old-fashioned way of drying hair. Just put this head covering on and the terry cloth does the job. The terry cloth is also good to use after a hair treatment or conditioning. I have used leather to make this head covering, this style of my invention provides an extra secure head covering that can be worn under a motorcycle helmet, keeping the riders hair contained and out of their way. In the leather style, I have added buckles and loop fasteners to the bottom and middle straps ensuring an extra level of securing this head covering onto the wearers head.

This product can be made in different lengths and sizes, accommodating the wearers individual needs as there are many different hairstyles and lengths. Also, a smaller pattern can be used for children. A pattern can also be made with only one set of bottom straps making this product shorter to show off the wearers hair more. My head covering also provides a new fashion style, as many different prints and fabrics can be used making this a product that can compliment any wardrobe.

A head covering is described that is adapted to be worn on a head of a wearer. The head covering comprises a hooded cap and an extension. The hooded cap includes a pair of ties that are adapted to secure the head covering to the head of the wearer. The extension connects to the hooded cap on one end and includes an opposing distal end portion that has a free terminal end. The distal end portion includes a flap. A pouch is connected to an inwardly directed surface of the extension. The pouch and extension define a first aperture in proximity to the hooded cap and a second aperture in proximity to the terminal end portion of the extension. A passageway is defined between the inwardly directed surface of the extension and the pouch. A plurality of connectors is positioned on the flap and the pouch. The flap is movable between an open position for the second aperture and a closed position for the second aperture. The connectors are positioned for the adjustable connecting of the flap to the pouch and securing of the flap and pouch together to close the second aperture. At least one strap connects to the extension. The straps are constructed for securing the extension and the hair together.

The head covering has a first position includes passing the head covering along the hair of the wearer from a distal end of the wearer's hair to the wearer's head. A second position of the head covering includes positioning the hooded cap of the head covering on the wearer's head. The hair of the wearer is at least partially positioned in the passageway defined by the extension.

The extension of the head covering is tied by the straps into an approximately columnar shape. The extension of the head covering can selectively have a wide flat shape. The straps are selectively employed in an untied position as a fashionable accessory. The extension can define a bun. The bun can be held in position by at least one of the straps, the ties or the tying of the extension to itself. The flap is selectively movable between the closed position that is adapted to retain the hair of the wearer in the pouch and the second position wherein the hair of the wearer can pass at least partially through the second aperture.

A head covering adapted to be worn on a head of a wearer. The head covering comprises a first position of the extension wherein the extension is tied into an elongate column using the straps, a second position of the extension wherein the extension is extended into a wide flat configuration and a third position of the extension wherein the extension is positioned in a bun.

The second position of the extension can include at least one of the straps loosely tied around the extension. The bun can be attached to the hooded cap using the ties. The bun is attached to the hooded cap using the straps. The bun is attached in proximity to the hooded cap by tying itself into the bun. The straps in any one of the positions can be left untied to make a fashion accent. The pouch is adapted to retain or pass through a portion of the hair of the wearer.

A method of attaching a head covering to the hair and head of a wearer. The head covering defines a passageway that receives the hair of the wearer. The method comprising the steps of providing a head covering that defines a hooded cap and an extension. The extension defines a selectively closeable passageway. A first position of the head covering that includes an arm of the assisting person being positioned through the passageway such that the hand of the assisting person is in proximity to the hooded cap. The assisting person grasps the hair of the wearer in proximity to a distal end of the hair of the wearer. A second position of the head covering wherein the head covering is passed along the arm of the assisting person and over the hair of the wearer from the distal end of the wearer's hair to the wearer's head. The hooded cap is then positioned onto the head of the wearer. The method also includes the positioning the hair of the wearer through the passageway or closing the passageway to retain the hair of the wearer within the head covering. Tying the ties of the hooded cap approximately behind the nap of the neck secures the head covering to head of the wearer. The method can further include employing the straps to position the extension and the hair of the wearer in the desired position.

The step of tying the ties can further include employing of the straps to position the extension and hair in a column configuration. The step of tying the ties can further include employing of the straps to position the extension and hair in a wide flat configuration against a back of the wearer. The step of positioning the hair of the wearer in the extension can further include using the extension to create a bun. The step of tying the ties can further include using the untied straps as fashion accents. The step of selectively positioning the hair of the wearer can further include adjustably closing the passageway to retain the hair in the desired configuration.

BRIEF DESCRIPTION OF THE DRAWINGS

Preferred embodiments of the invention are described below with reference to the drawings, wherein like numerals are used to refer to the same or similar elements.

DETAILED DESCRIPTION OF THE INVENTION

Figure 1:
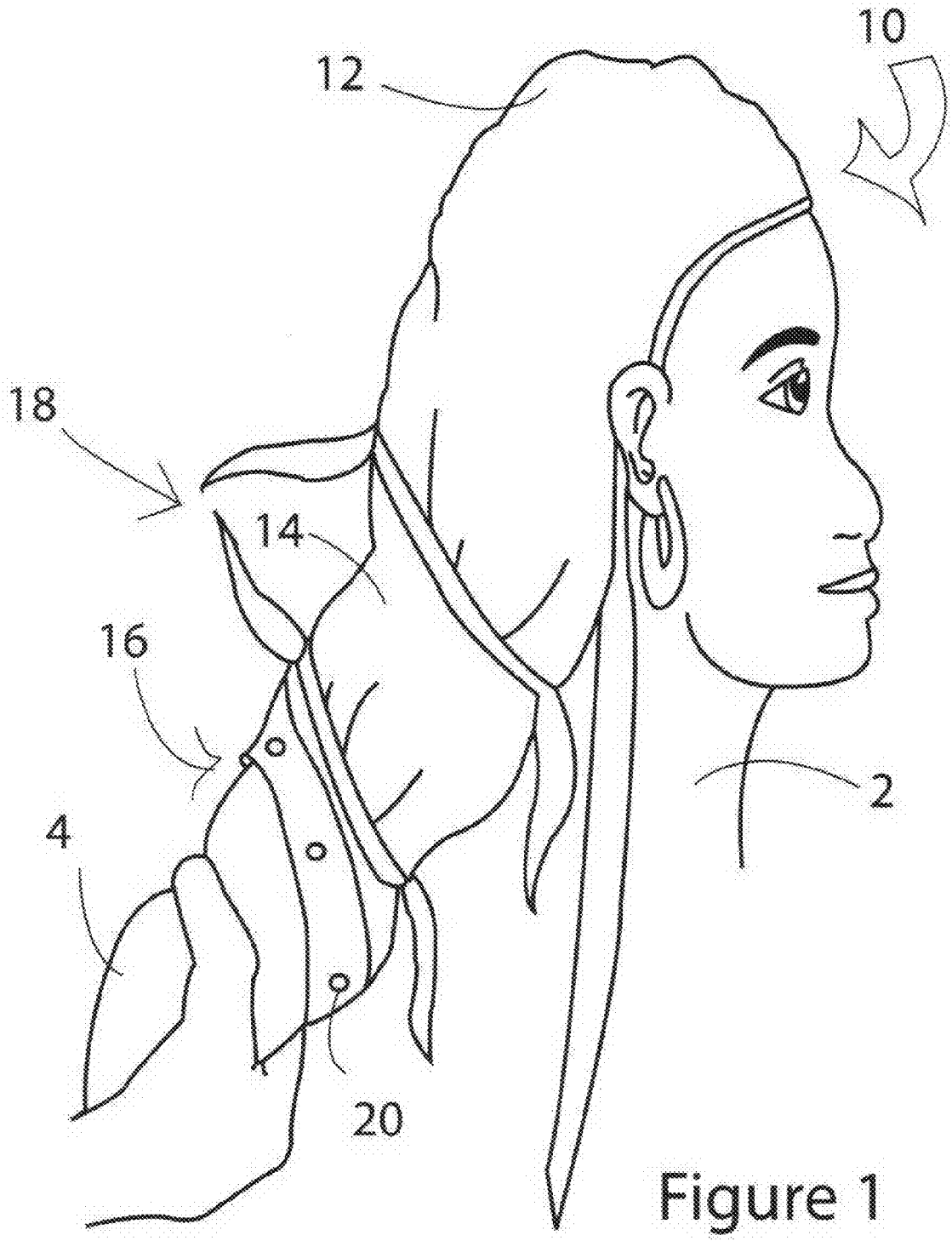
FIG. 1 is a right side view of the locks down head covering constructed in accordance with the present disclosure.
Figure 2:
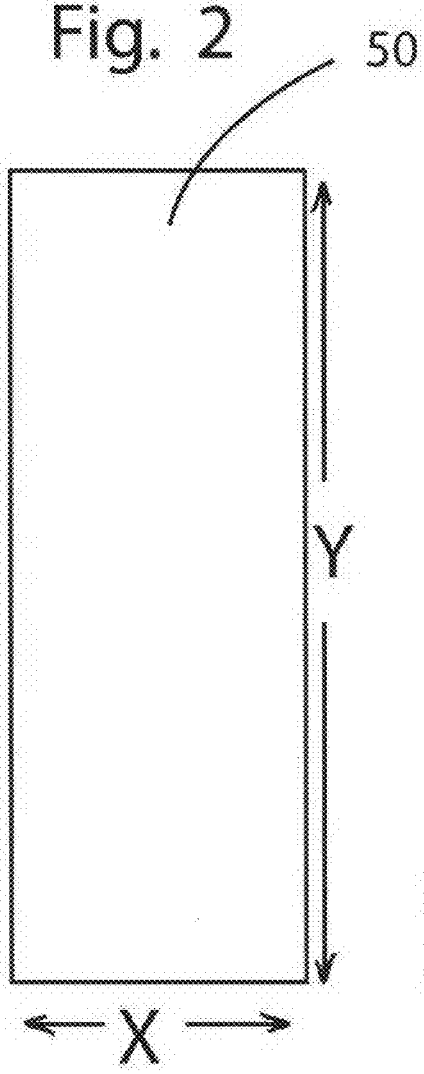
FIG. 2 is a top view of an outer fabric of the had covering of FIG. 1.
Figure 3:
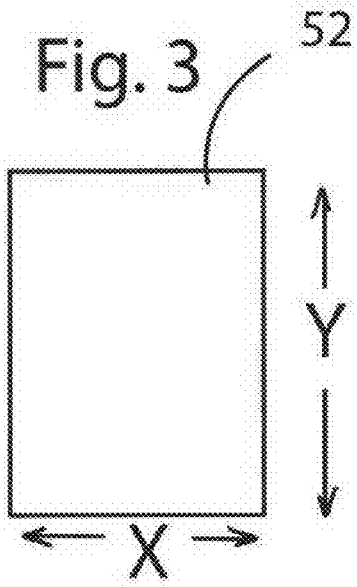
FIG. 3 is a top view of a pocket of the head covering of FIG. 1.
Figure 4:
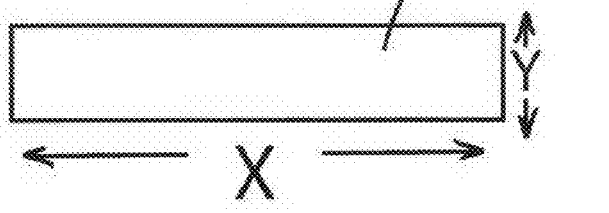
FIG. 4 is a top view of a strap of the head covering of FIG. 1.

Referring initially to FIG. 1, this disclosure relates to a head covering 10 that is an accessory hair care product and a method of position head covering 10 onto a wearer 2. Head covering 10 is a single piece head covering that includes a hooded cap 12 and an extension 14. Hooded cap 12 covers a substantial portion of the top, sides and back of a head of wearer 2. In this one preferred embodiment a distal end portion 16 of head covering 10 is in an open position and the hair 4 of wearer 3 extends through and out of head covering 10. At least one strap 18 connects extension 14 and hair 4. Connectors 20 are selectively used to connect portions of head covering 10 together to secure distal end portion 16 in a closed position.

As shown in FIGS. 1-4, head covering 10 is preferably made from approximately seven pieces of cloth. A first or outer piece of uncut fabric 50 is shown in a rectangular shape. First piece 50 can be one piece folded along one of the edges parallel to a Y-axis or two pieces. In this one preferred embodiment, the X-axis is approximately 15 inches long and the Y-axis is approximately 29 inches long. A rectangular shaped second piece of fabric or pocket 52 is approximately 11 by 12 inches. A third piece of fabric 54 is one of the at least one strap 18 and has an approximately rectangular shape with dimensions of approximately 4 inches by approximately 23 inches.

Figure 6:
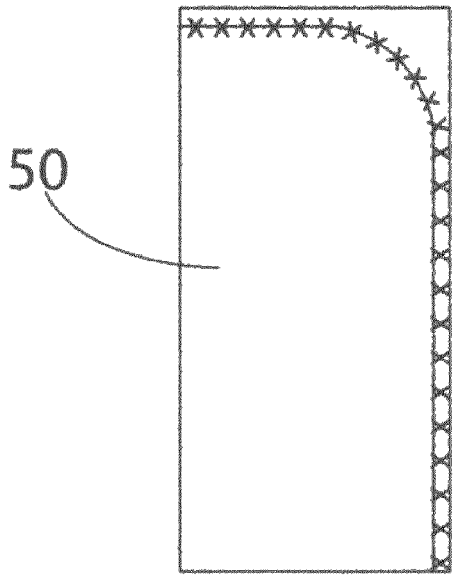
FIG. 6 is a top view of the seam and cut that connects the two outer fabrics of FIG. 5.
Figure 5:
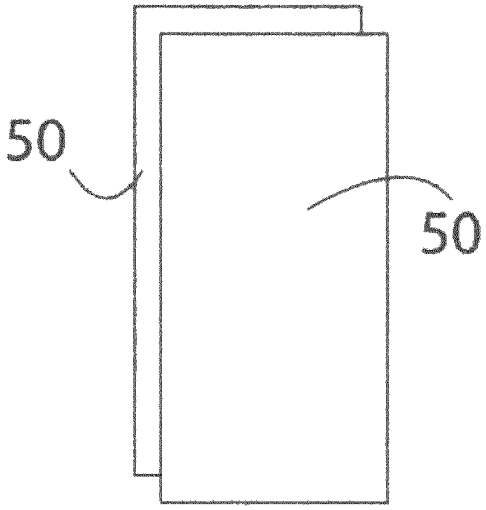
FIG. 5 is a top view of the two outer fabrics of FIG. 2 in a partially overlaid position.
Figure 7:
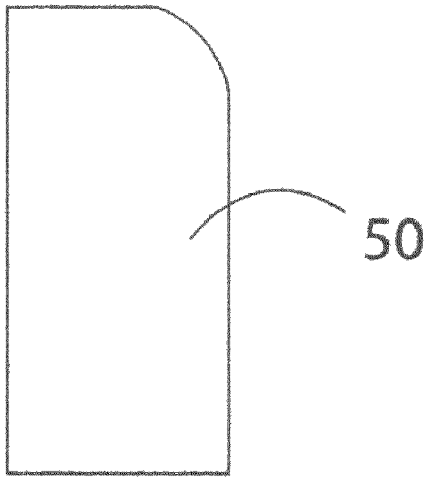
FIG. 7 is a top view of the cut outer fabric of FIG. 6.
Figure 8:
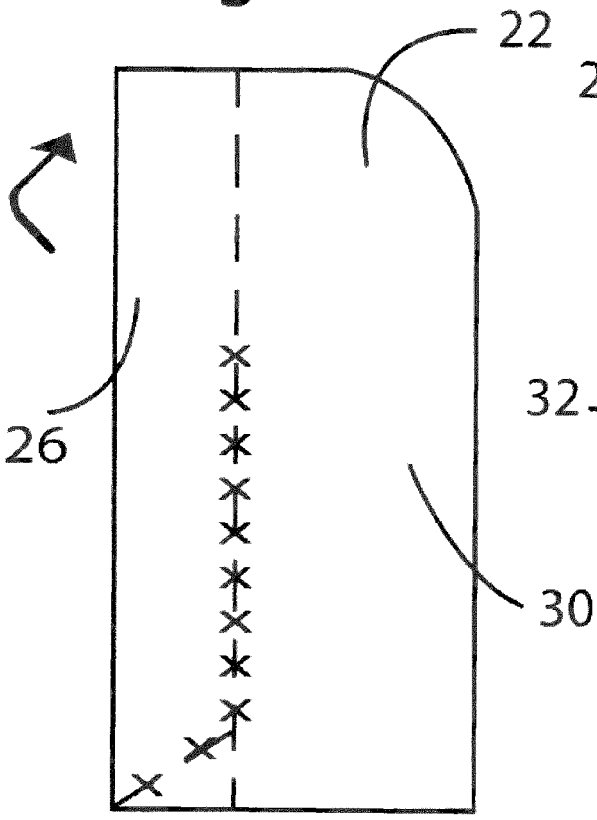
FIGS. 8-11 are top views of folding and cutting the outer fabric of FIG. 6.
Figure 9:
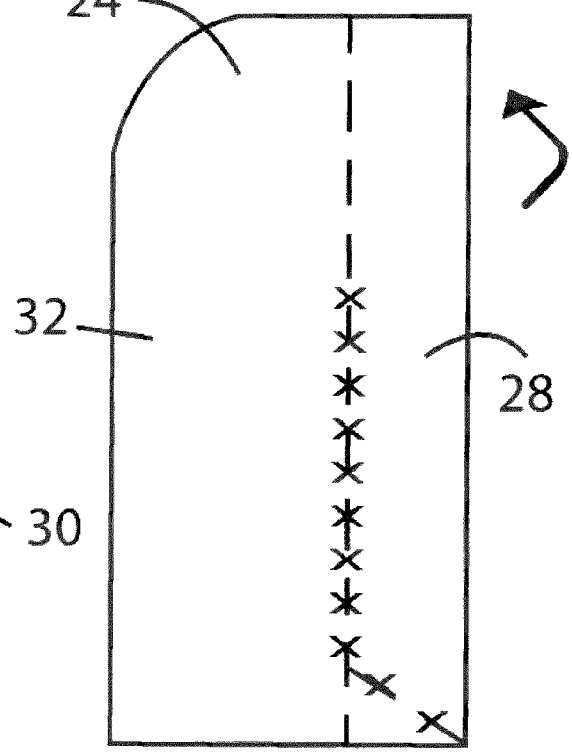
Figure 10:
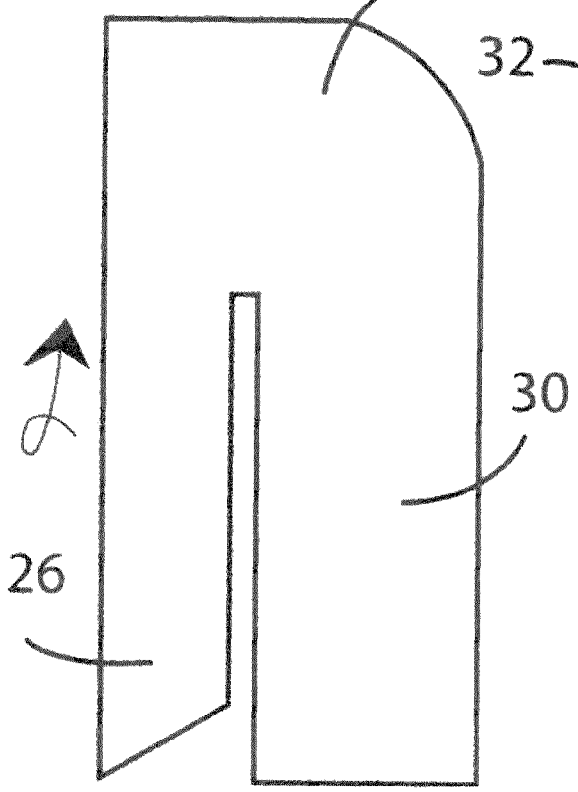
Figure 11:
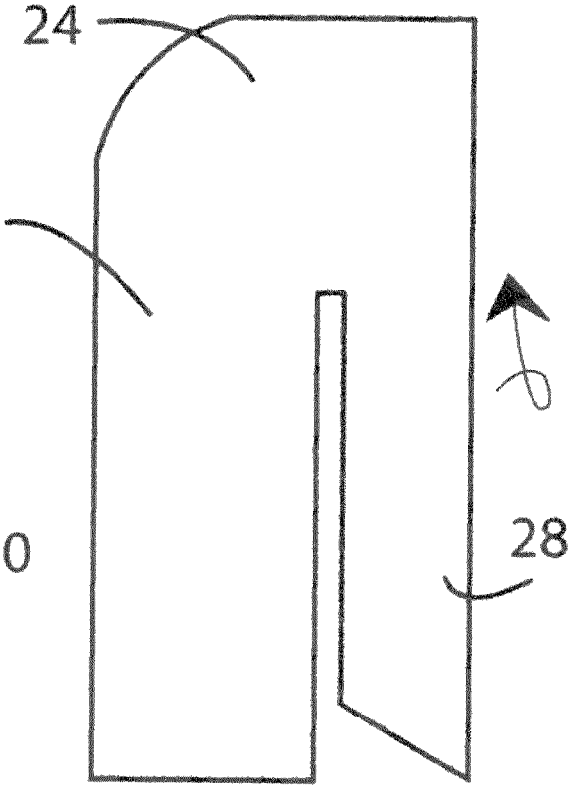

As shown in FIGS. 5-7, the single or two pieces of fabric 50 are laid over one another, trimmed along two adjoining edges, the adjoining corner rounded and then the trimmed edges connected together in proximity to the trimmed arcuate edge by means known in the art such as sewing. The method of connecting fabric 50 is dependent upon the type of material and can alternatively include head bonding or other forms of connection.

Referring now to FIGS. 8-11, in these exemplary figures the left tie 26 and the right tie 28 are shown being cut from left side 22 and right side 24. As required, the edges are trimmed and the terminal end of each tie preferably has an angled terminal end.

Figures 12, 13:
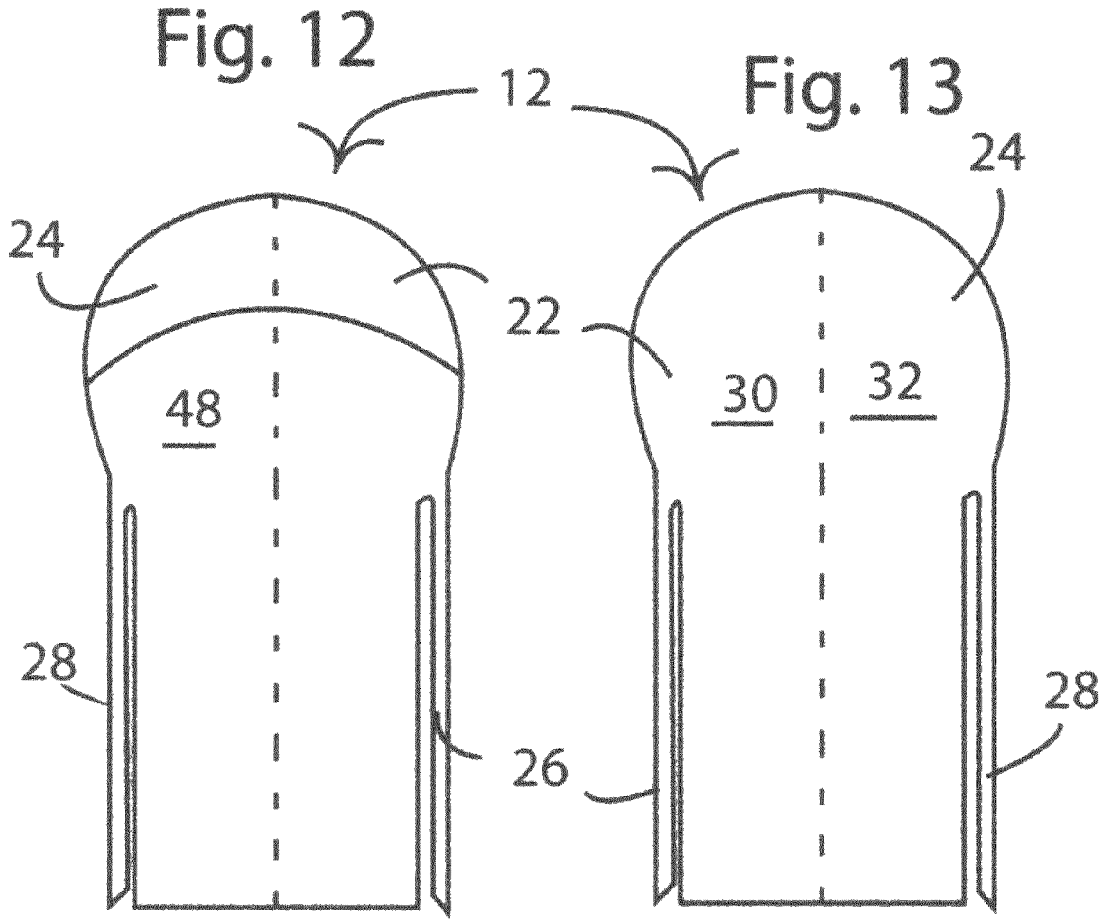
FIG. 12 is a front view of the head covering as assembled inn FIGS. 8-11.
FIG. 13 is a rear view of the head covering of FIG. 12.

FIGS. 1, 12 and 13 show the approximately hemispherical arcuate shape of hooded cap 12 and the relative position of ties 26 and 28. Left side 22 and right side 24 of hooded cap 12 are joined at a seam that runs from distal end portion 16 to the front of cap 12. It is understood that while cap 12 and extension 14 are shown as being assembled from one or two pieces of fabric 50, head covering 10 can be made from any number of pieces of fabric 50.

Figure 14:
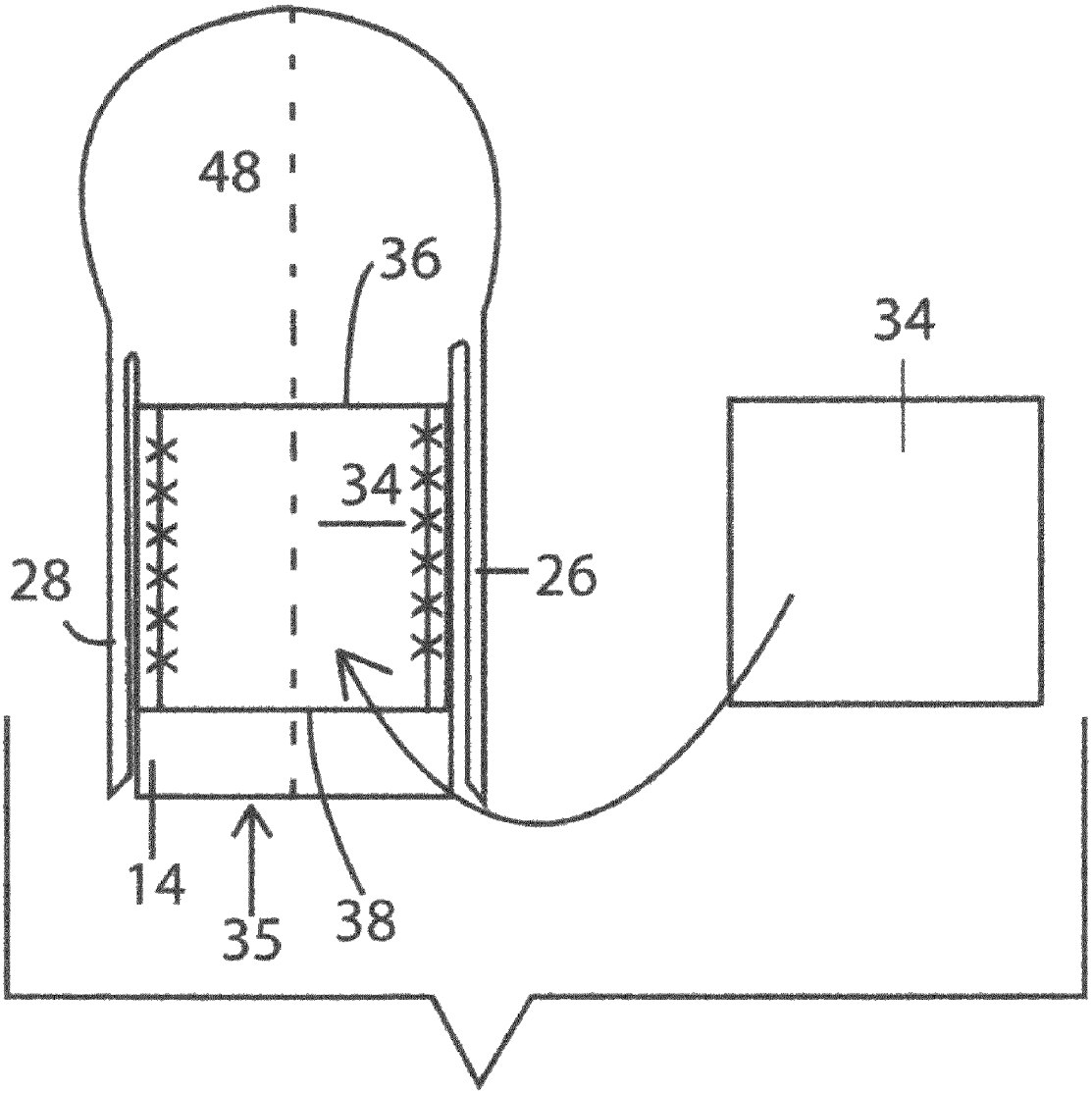
FIG. 14 is the front view of the head covering of FIG. 12 that includes a hooded cap and an extension, a pocket being connected to the extension.

As shown in FIG. 14, pouch 34 connects to an inwardly directed surface or inside surface 48 of extension 14. The left and right edges of pouch 34 are preferably connected to extension 14 in proximity to the left side and right side of extension 14. This connection defines a passageway 33 between a first upper edge 36 and a second lower edge 38 of pouch 34 and extension 14.

Figure 15:
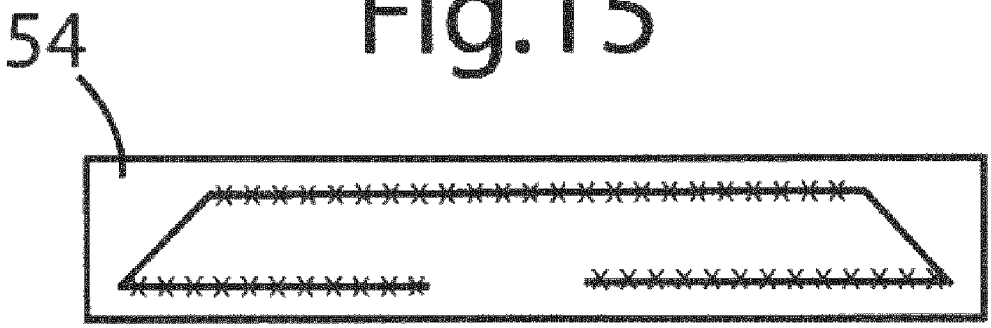
FIG. 15-16 are top views of the constructing of the straps of the head covering of FIG. 1.
Figure 16:
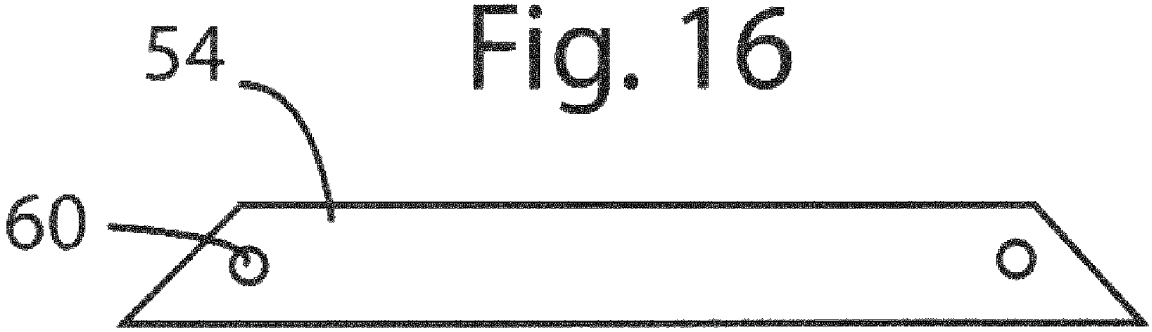

Referring now to FIGS. 15 and 16, the cuts and trims for the formation of at least one strap 18 from strips of fabric 54 are shown. Connectors 60 in proximity to the opposing left and edges of straps 18 adjustably connect together to fasten each strap 18 together.

Figure 17:
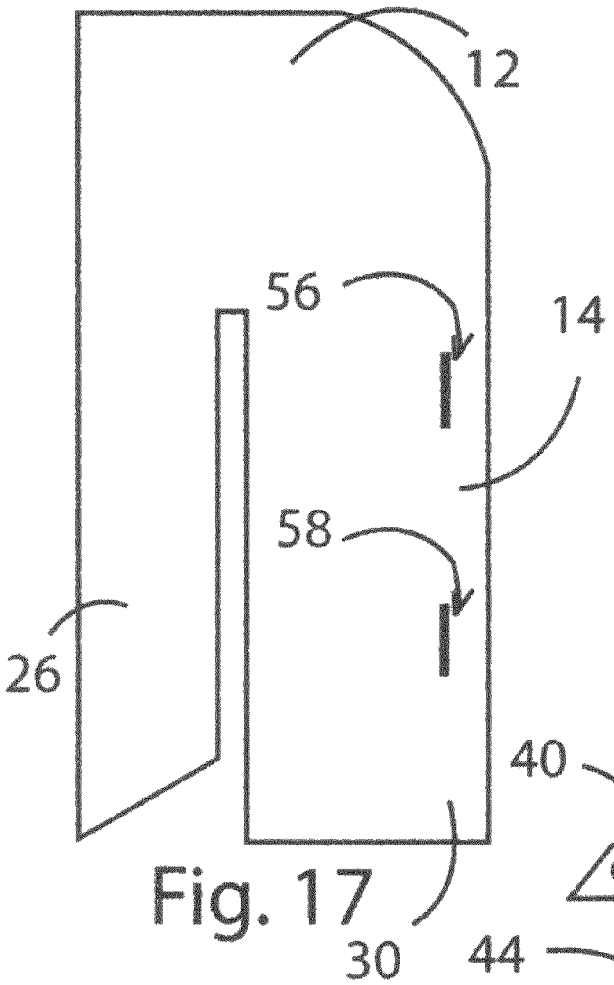
FIG. 17 is a left side view of the head covering of FIG. 14 that shows the placement of apertures for the straps.
Figure 18:
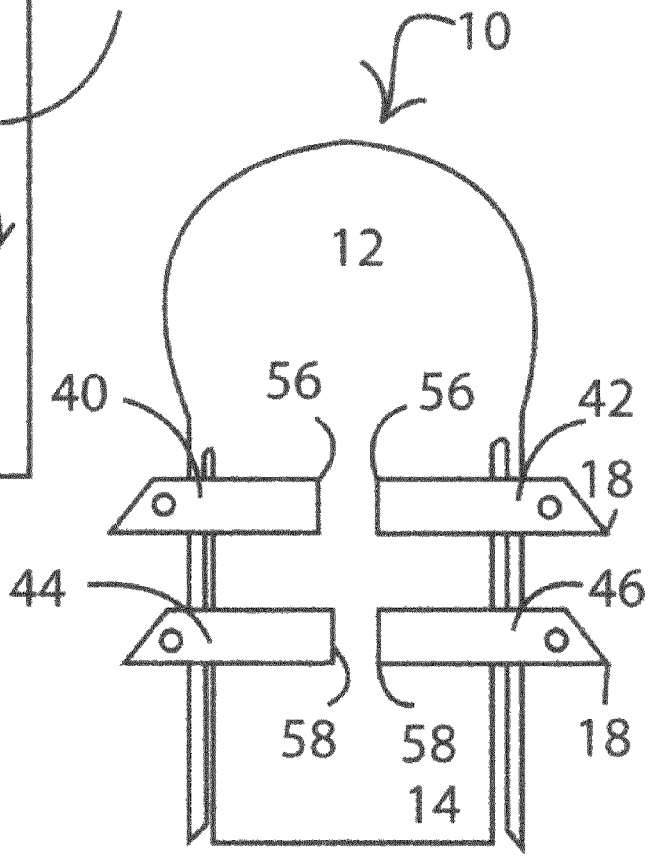
FIG. 18 is an idealized rear view of the head covering of FIG. 1 that shows the position of the straps.

As shown in FIGS. 16, 17 and 18, the placement of apertures 56 and 58 in extension 14 of head covering 10 are between a lower bottom portion 30 and hooded cap 12. Straps 18 are passed through apertures 56 and 58 and connected to extension 14 in proximity to the left to right midpoint along the X-axis of straps 18. Straps 18 are preferably fixedly connected to extension 14 by sewing them in position. Upper strap 18 has a left portion 40 and a right portion 42. Lower strap 18 has a left portion 44 and a right portion 46. Connectors 60 preferably face inwardly towards the wearer with the single connector on the left portion 40, 44 adjustably connecting to one of the plurality of connectors to the corresponding opposing right portion 42, 46. It is understood that connector 60 can be any form mechanical connection device such as a snap, a tie, hook and loop device, etc. It is also understood that connector 60 includes straps 18 connecting their respective right and left portions together in a knot.

Figure 19:
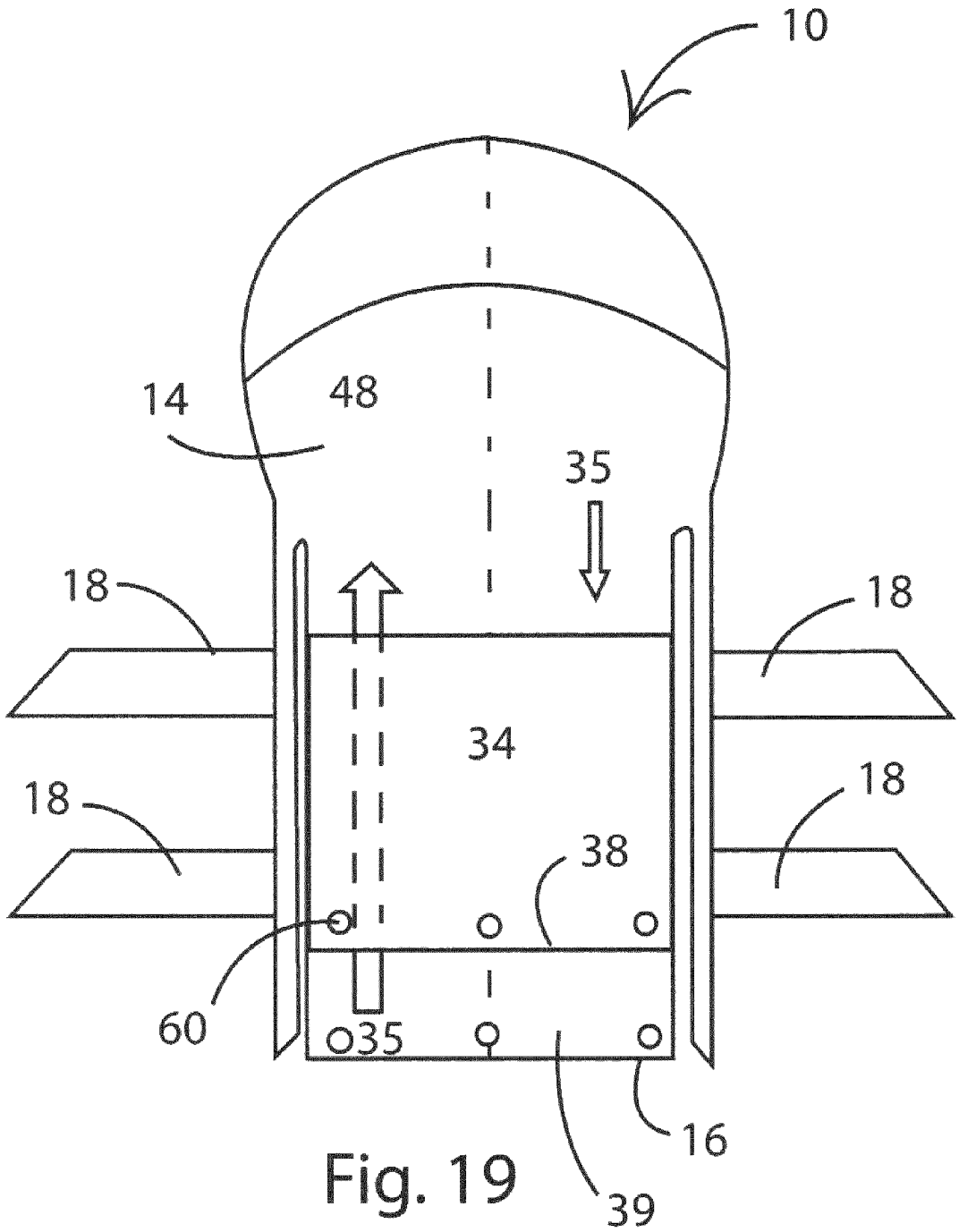
FIG. 19 is an idealized front view of the head covering of FIG. 1.

Referring now to FIG. 19, inwardly directed surface 48 of head covering 10 terminates at distal end portion 16. Extension 14 distal end portion 16 includes a flap 39. A plurality of connectors 60 are positioned on the inwardly directed surface 48 of flap 39 and pouch 34 that correspondingly adjustably mate to secure open end 38 of passageway 35. Connectors 60 on flap 39 and pouch 34 can optionally secure lower aperture 38 to a closed position.

Figure 20:
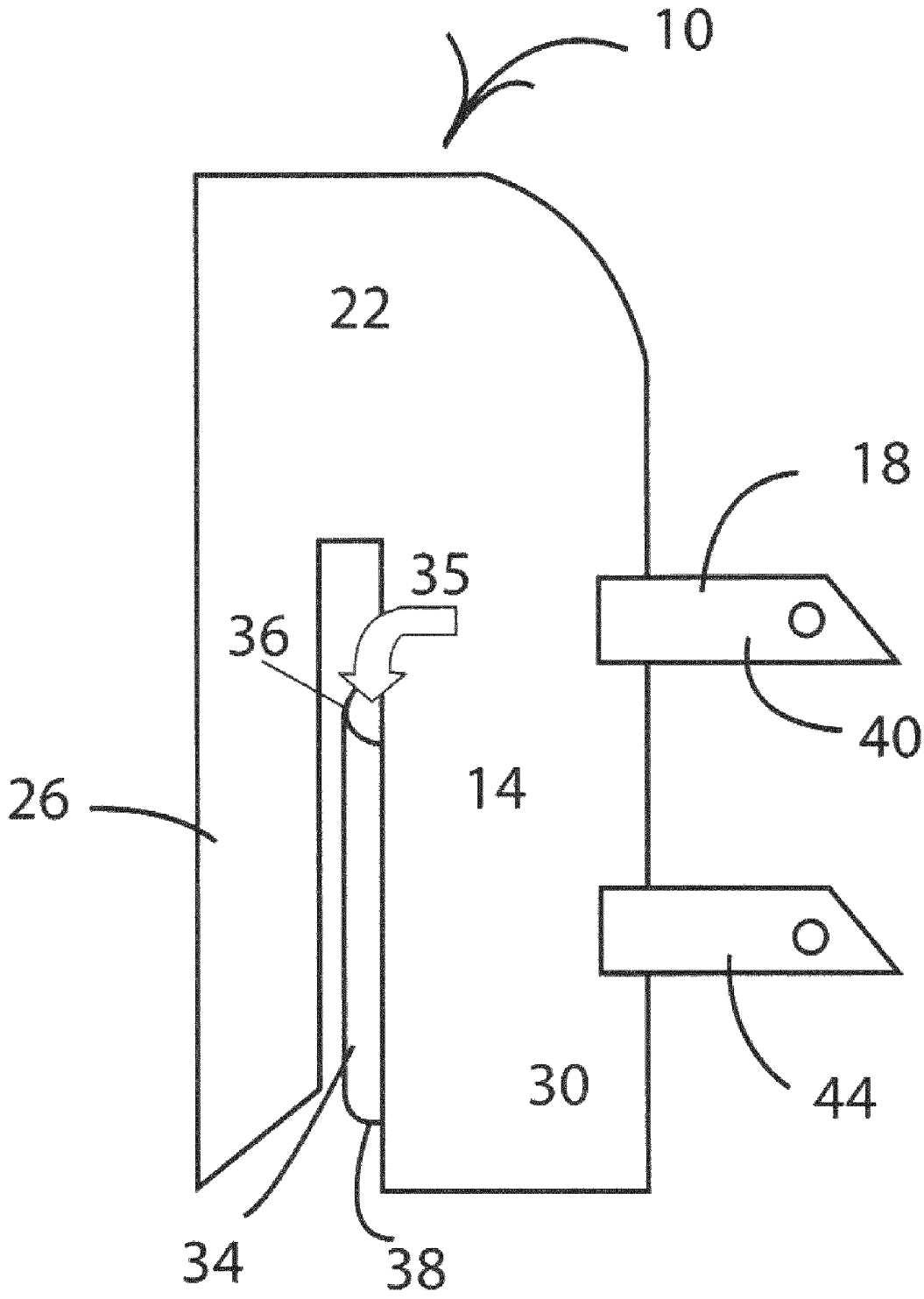
FIG. 20 is an idealized left side view of the head covering of FIG. 19.

As shown in FIGS. 19 and 20, head covering to includes hooded cap 12, extension 14, adjacent left tie 26 and straps 18. Pocket 34 upper aperture 36 is positioned in spaced relation to extension 14 in an open position. Left strap 18 portions 40 and 44 extend from extension 14. Passageway 35 extends along the inwardly directed surface of lower left bottom portion 30 and through apertures 36 and 38 of pocket 34.

Figure 21:
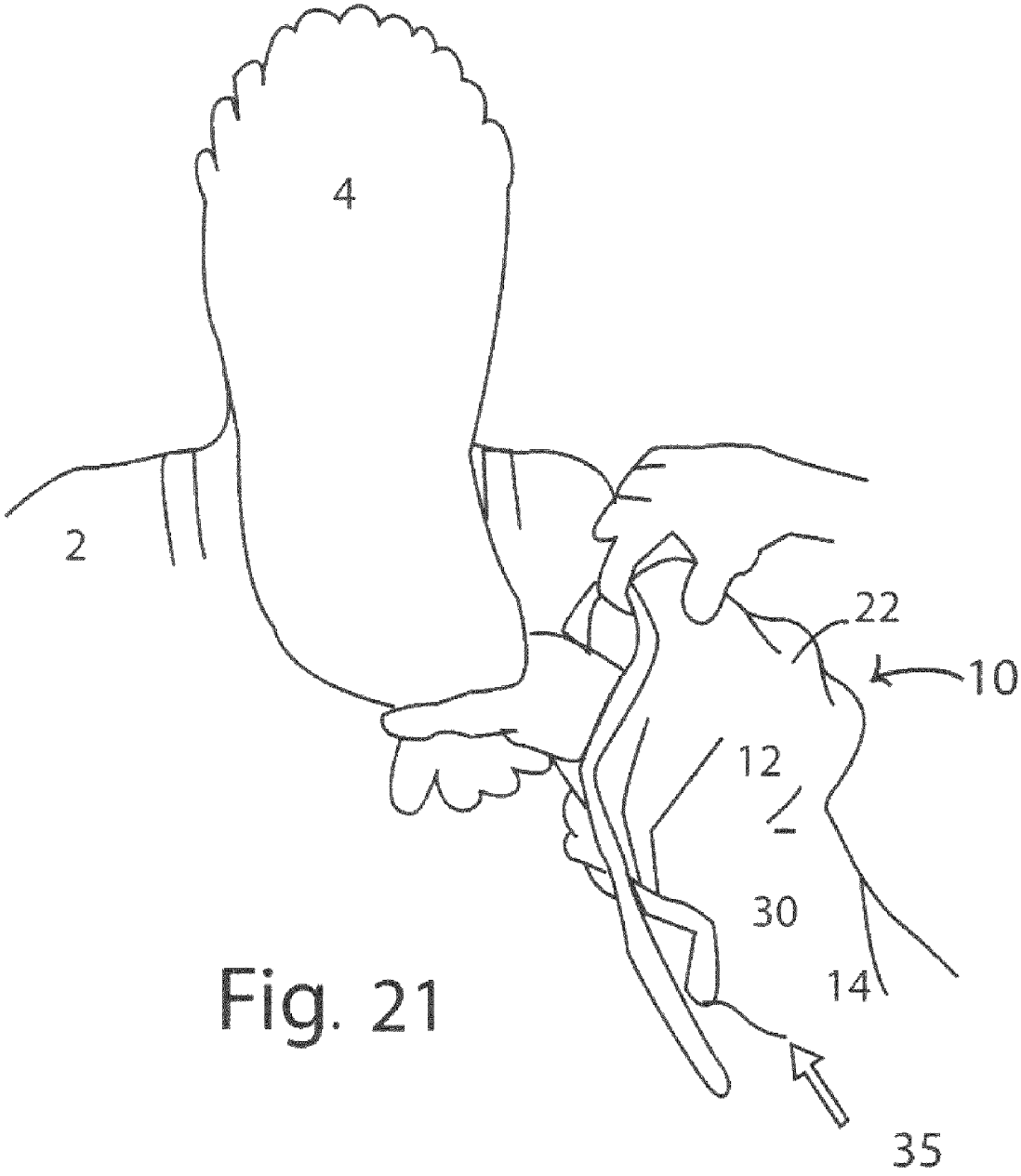
FIG. 21 is a rear view of the head of the wearer and the head covering of FIG. 1 with the hair of the wearer being positioned through the head covering.
Figure 22:
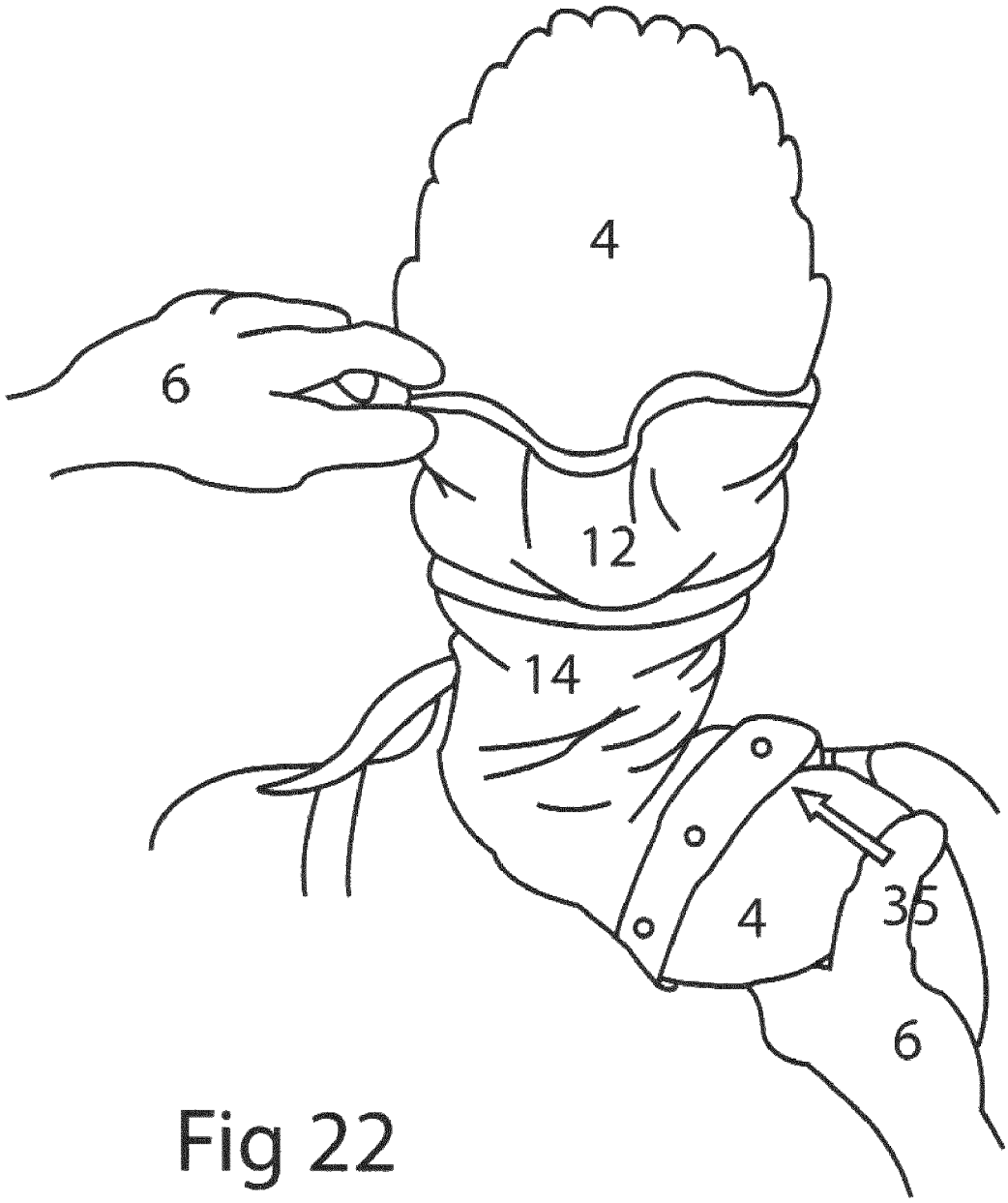
FIG. 22 is the rear view of the head covering of FIG. 21 with the head covering being positioned onto the head of the wearer.

Referring now to FIGS. 21-22 in operation, a first person assists the positioning of head covering 10 on wearer 2. In this preferred embodiment, a hand 6 of the first person extends through passageway 35 of extension 14 and the opening defined by hooded cap 12 to grasp hair 4 of wearer 2 in proximity of the ends of hair 4. Head covering 10 is then slid along the arm and past the hand 6 of the first person and hooded cap 12 is positioned on a head of wearer 2. This process includes positioning hair 4 through pocket 34 (see FIG. 20) and then positioning the wrap or hooded cap 12 onto the wearer's head vice putting hooded cap 12 on the wearer's head first and then struggling to wrap the wearer's pony tail into the extension 14 portion of the hair care product. Instead, hair 4 in the present disclosure goes into, can be passed through or can be selectively contained by pocket 34 of extension 14.

Figure 23:
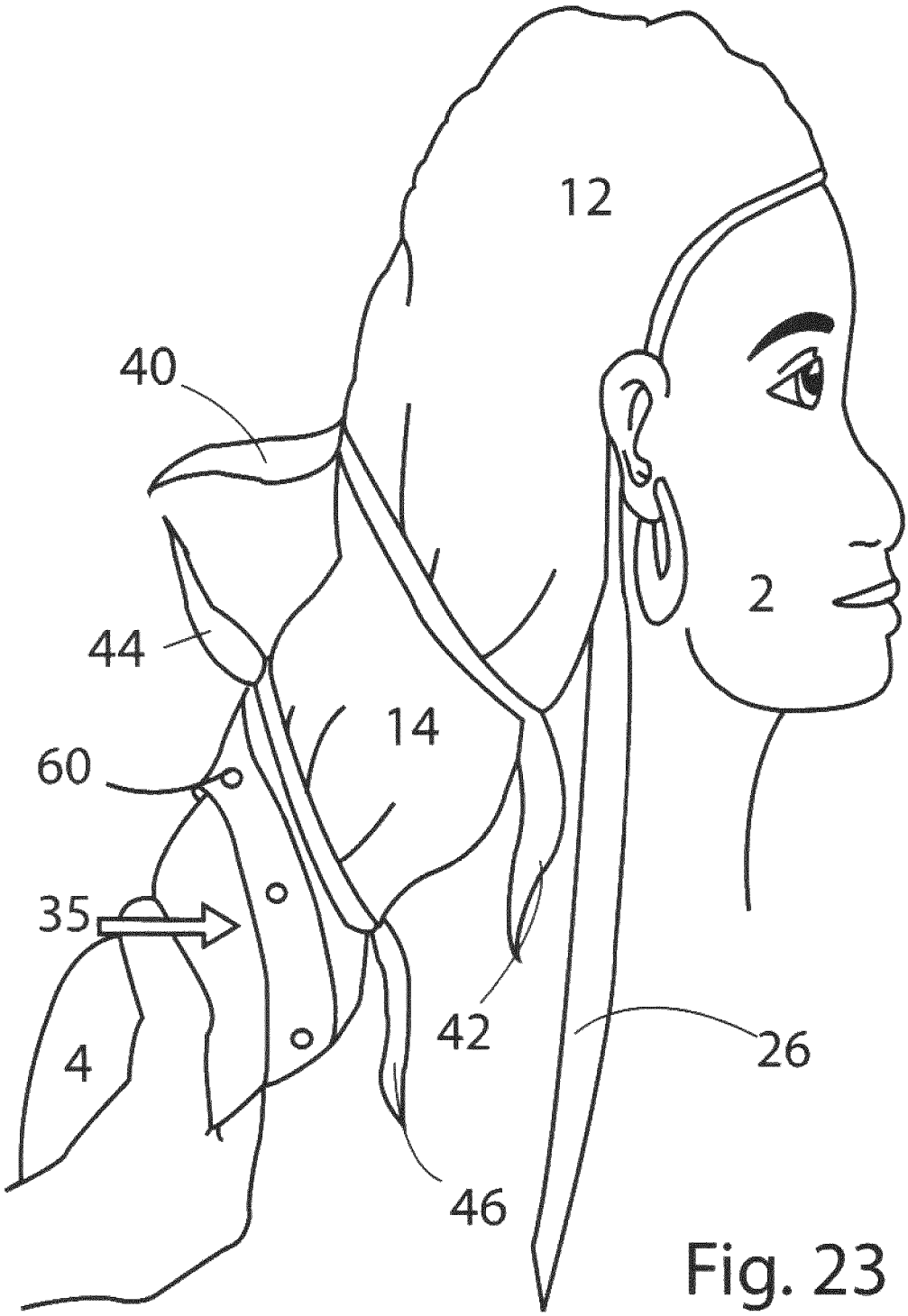
FIG. 23 is a left side view of the head covering of FIG. 21 with the tie untied and the straps connected.
Figure 24:
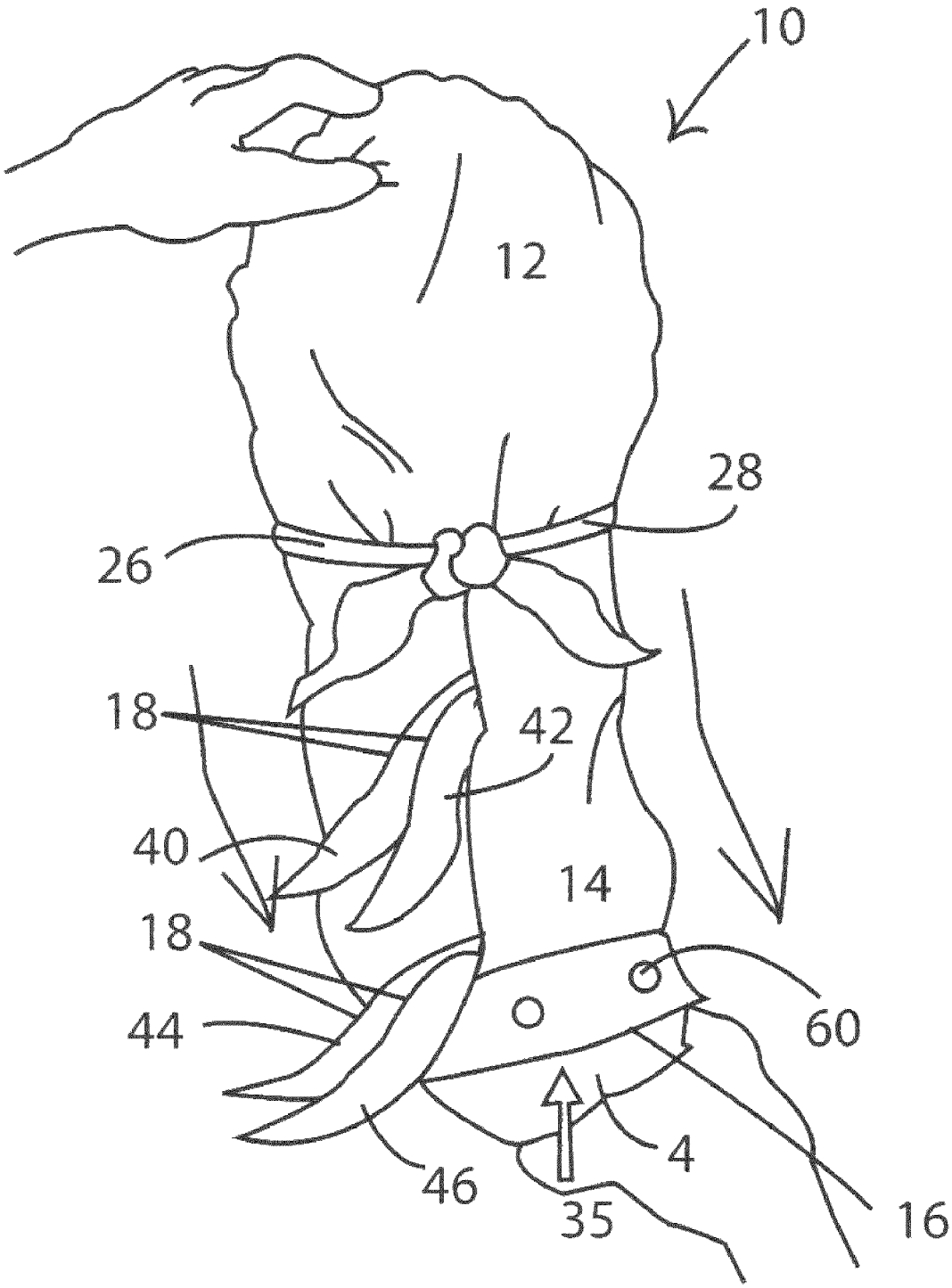
FIG. 24 is a rear view of the head covering of FIG. 21 with the tie tied, the straps tied and the hair extending through the extension.

As shown in FIGS. 23 and 24, once hooded cap 12 of head covering 10 is positioned on the head of the wearer 2 and secured by ties 26 and 28 against the nap of the neck. Left portions 40 and 44 and right portions 42 and 44 of middle and bottom straps 18 can be connected together, respectively or left unconnected and hanging as an ornamental accent. Hair 4 extends through passageway 35 and past edge 16 of extension 14. Connectors 60 are preferably positioned on the inwardly directed surface 48 (see FIG. 19) of distal end portion 16 of extension 14, but can alternatively extend through to the outwardly directed surface of extension 14 as either a subdued connector or, as a further alternative, an additional ornamental feature to head covering 10.

Figure 25:
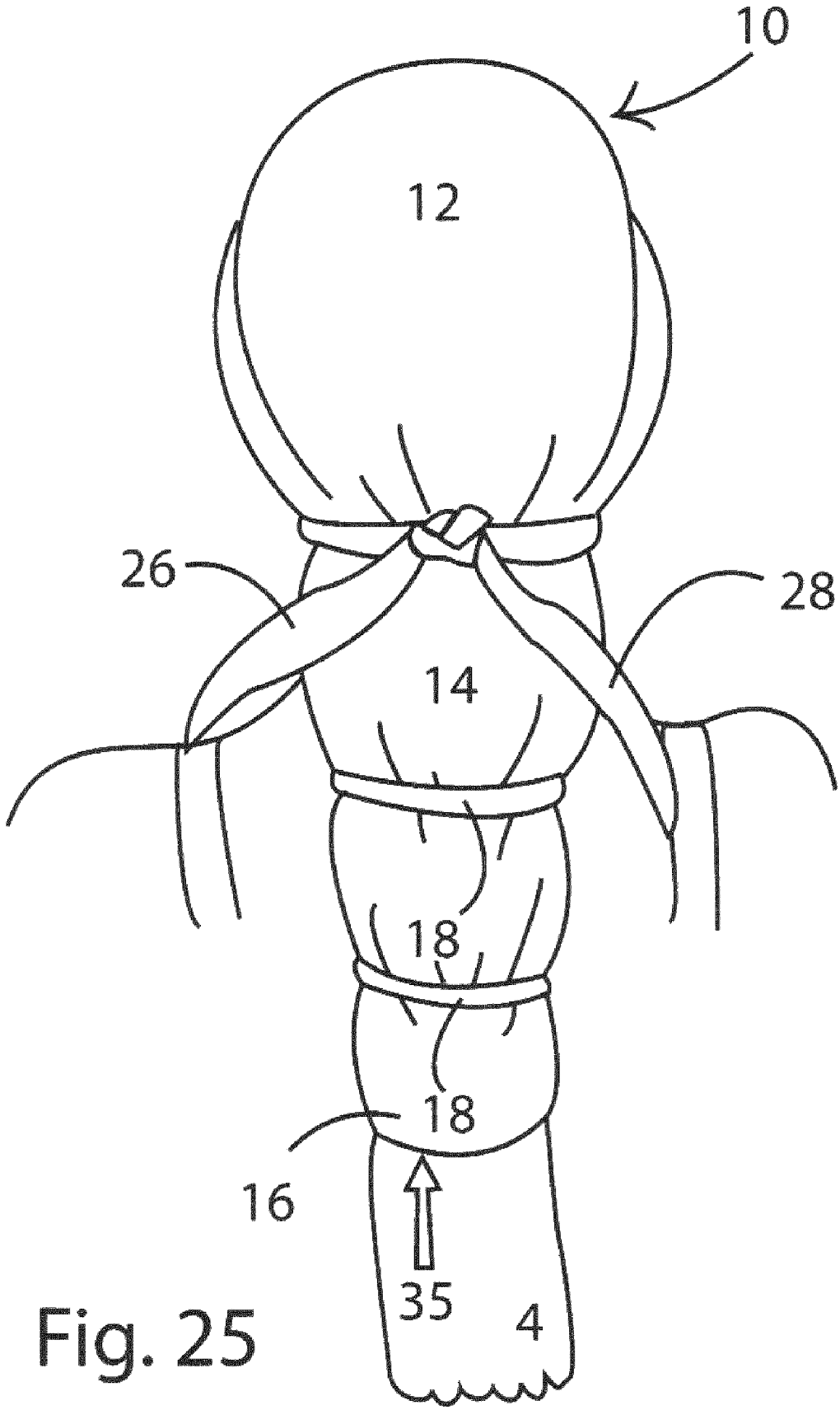
FIG. 25 is a rear view of the head covering of FIG. 21 with the tie tied, the straps tied and the hair of the wearer extending from the extension.
Figure 26:
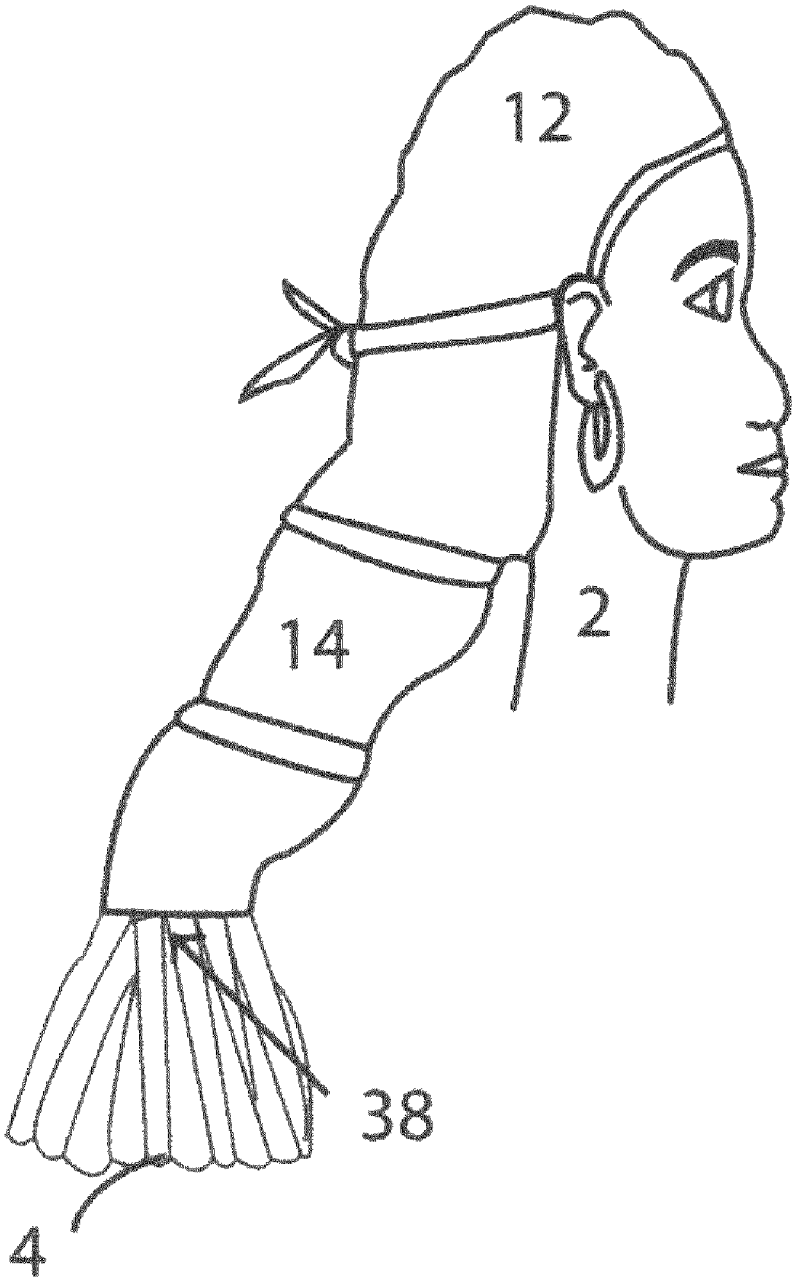
FIG. 26 is a rear view of the head covering of FIG. 21 with the tie tied, the straps tied and the hair of the wearer extending from within the pouch.

As shown in FIGS. 25 and 26, one preferred embodiment of head covering 10 includes ties 26 and 28 tied together and the left sides 40, 44 and corresponding right sides 42 and 46 of straps 18 are connected together on the inward directed side of extension 14. In this embodiment, hair 4 of wearer 2 extends past the terminal end 16 of extension 14.

Figure 27:
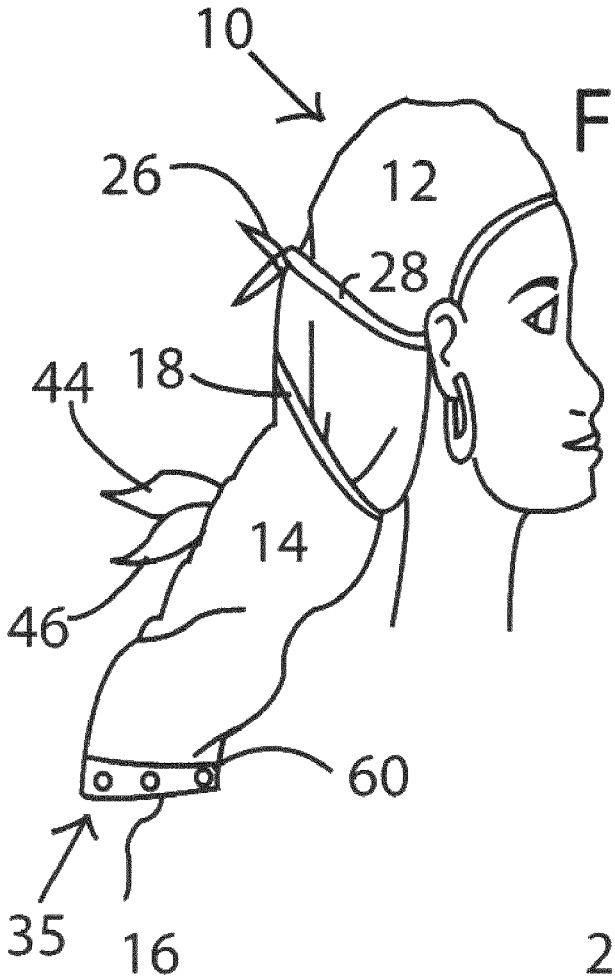
FIG. 27 is a right side view of the head covering of FIG. 21 with the tie tied, one strap tied, one strap untied and the hair of the wearer retained within the pouch.
Figure 28:
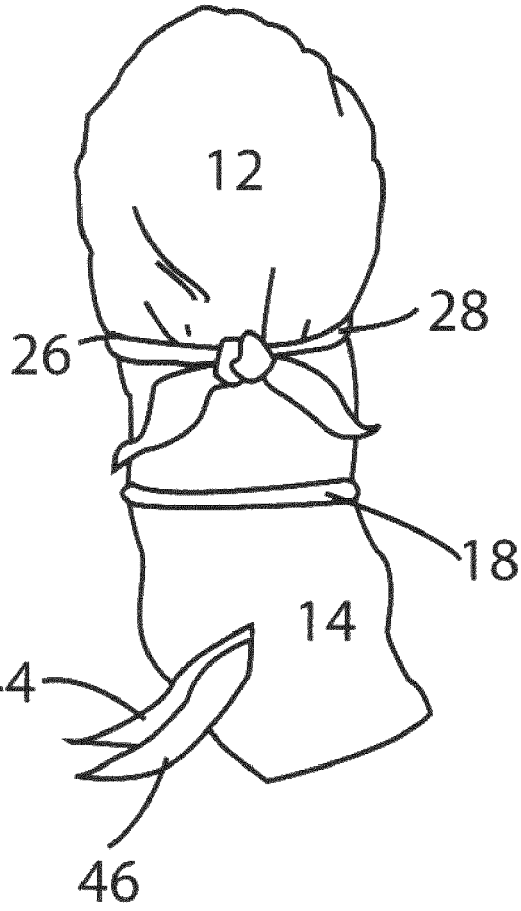
FIG. 28 is a rear view of the head covering of FIG. 27 with the tie tied, one strap tied, one strap untied and the hair of the wearer retained within the pouch.

Referring now to FIGS. 27 and 28 in one variation of head covering 10 left tie 26 and right tie 28 are connected together in proximity to the nap of the neck of the wearer 2. Upper strap 18 is loosely connected together on the inwardly directed side of extension 14 and lower strap 18 left side 44 and right side 46 are left free and untied or unconnected. In the instance of FIG. 27, extension 14 is turned to show distal end portion 16. Extension 14 has a wide flat appearance in contrast to the tight columnar shape of FIG. 25. Hair 4 of wearer 2 is contained within head covering 10 and passageway 35 is closed by securing the connectors 60 of pouch 34 (not shown) and connectors 60 of distal end portion 16 together. When hair 4 is contained in pouch 34 and extension 14 is secured to close aperture 38, connectors 60 are preferably not outwardly visible.

Figure 29:
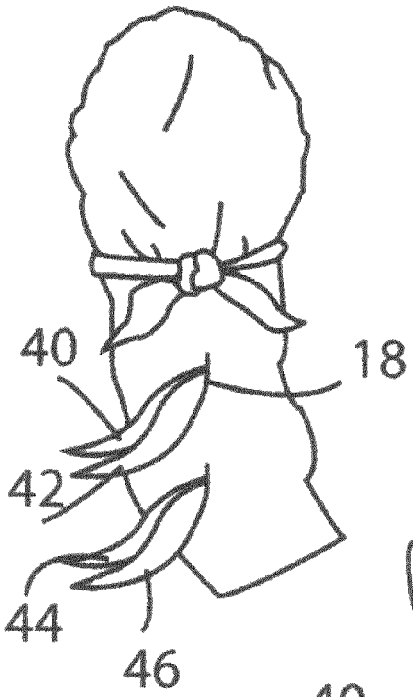
FIG. 29 is a rear view of the head covering of FIG. 21 with the tie tied and the straps untied.

As shown in FIG. 29 in another alternative variation of head covering 10, left tie 26 and right tie 28 are connected together in proximity to the neck of the wearer 2. Strap 18 left ends 40, 44 and right ends 42, 46 are left free and untied to provide a stylish alternative head covering 10. Straps 18 can be decorated fashion accessories by using a different kid of fabric from that of extension 14, sequins, etc. Extension 14 has a wide flat appearance.

Figure 30:
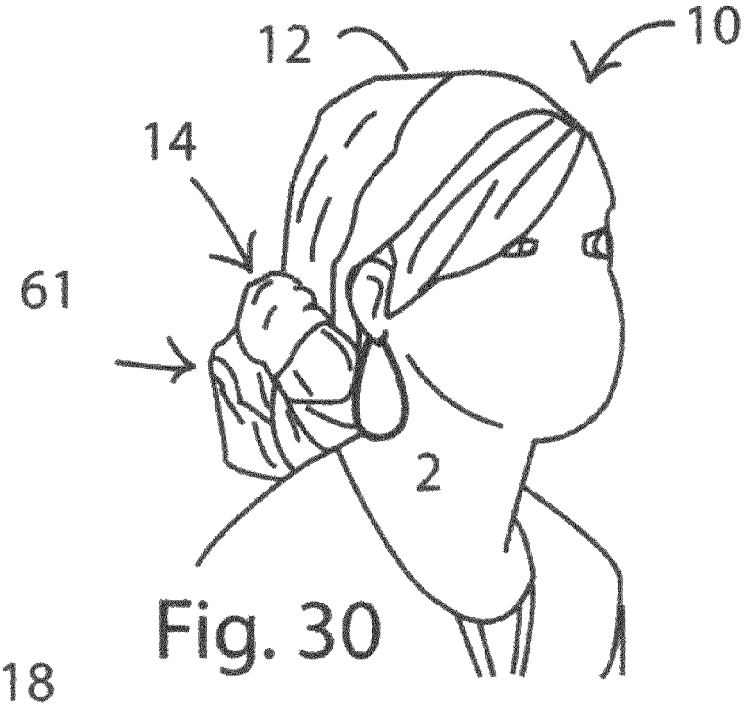
FIG. 30 is a rear view of the head covering of FIG. 21 with the tie tied and the straps untied.
Figure 31:
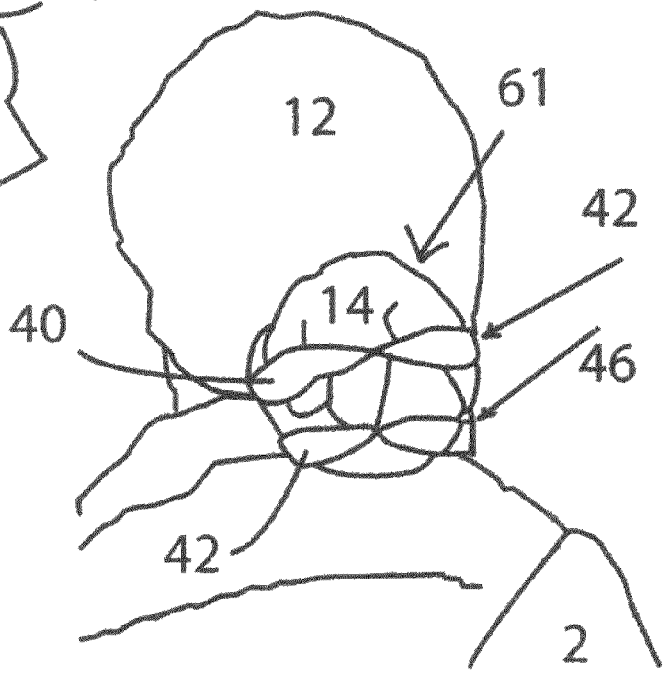
FIG. 31 is a rear view of the head covering of FIG. 30 with the extension tied into the bun.

Referring now to FIGS. 30 and 31 extension 14 can be tied into a bun 61 against and/or in proximity to hooded cap 12. Bun 61 can be retained in position solely using extension 14 to tie unto itself, using straps 18 and/or ties 26 and 28. Bun 61 can be positioned adjacent the nap of wearer's 2 neck, on the side of wearer's 2 head or the upper portions of cap 12. Extension 14 can also advantageously be wrapped and tied around hooded cap 12 selectively using extension 14, cap 12, ties 26, 28 and straps 18.

As shown in FIGS. 1, 18 and 19, the different positions of head covering 10 provide distinct structural and fashion advantages to wearer 2 that include the ability to stylishly wear head covering 10 on one occasion with any variation of straps 18 tied or loose and hair 4 extending past end 16. This variation of head covering 10 provides the luxury of having the head covered, the long hair 4 held in place, while being able to see the hair flowing from distal end portion 16. Connectors or snaps 60 give the option of closing aperture 38 if the wearer so chooses or keeping aperture 38 open so hair 4 of wearer 2 can flow through pouch 34 giving the wearer the opportunity to show off their hair, while keeping it in place in a fashion conscious manner. Alternatively, when wearer 2 desires to conceal hair 4 to keep hair clean when performing certain tasks, for example, distal end portion 16 can be secured to pouch 34 closing aperture 38.

The operational method of applying this head covering is unique, as no other hair covering product is constructed or designed in a way that can use this method and provide these flexible approaches. The head covering 10 has an aperture 38 in proximity to distal end portion 16 that is sized and dimensioned so that hand 6 of the assisting first person can slip through passageway 35 for the grabbing of hair 4 and pulling of hair 4 and extension 14 through head covering 10. This process makes the using of this head covering simple for the first person to employ and retain the pre-existing hairstyle of wearer 2. In addition, this unique process can be performed with hair 4 of wearer in a natural unbounded state, i.e., without being wrapped or tied and keeps the hair style of wearer 2 from being disturbed during the positioning of hooded cap 12 and extension 14.

It is a further attribute of head covering 10 that it can flexibly accommodate three different styles. A first style in which the straps are employed to tie hair 4 into a roll, pony tail or elongate columnar shape, a second style in which the straps can be loosely tied or left untied extension 14 and hair 4 lies flat against the back of wearer 2 in a wide flat configuration and a third style in which extension 14 can be tied into a bun. The bun can be tied solely using extension 14 or with the addition of at least one strap 18 and/or ties 26 and 28. The unique structural configuration of heading covering 10 enables this high level of fashion flexibility.

In the preceding specification, the present disclosure has been described with reference to specific exemplary embodiments thereof. It will be evident, however, that various modifications, combinations and changes may be made thereto without departing from the broader spirit and scope of the invention as set forth in the claims that follow. For example, the preferred construction using multiple pieces and their individual dimensions can be varied depending upon the intended application of head covering 10. Thus, the embodiments described herein can be applied or combined as novel features between the embodiments described herein. The drawings and specification are accordingly to be regarded in an illustrative manner rather than a restrictive sense.

What is claimed is:

1. A head covering adapted to be worn on a head of a wearer, the head covering comprises:

a hooded cap that includes a pair of ties, the hooded cap adapted to be secured to the head of the wearer using ties;

an extension that connects to the hooded cap on one end and includes an opposing distal end portion that includes a free terminal end, the distal end portion includes a flap;

a pouch connected to an inwardly directed surface of the extension, the pouch and extension define a first aperture in proximity to the hooded cap and a second aperture in proximity to the terminal end portion of the extension, a passageway defined between the inwardly directed surface of the extension and the pouch;

a plurality of connectors positioned on the flap and the pouch, the flap movable between an open position for the second aperture and a closed position for the second aperture, the connectors positioned for the adjustable positioning of the flap onto the pouch and securing of the flap and pouch together to close the second aperture; and at least one strap connected to the extension, the strap constructed for securing the extension.

2. The head covering of claim 1, wherein the extension of the head covering includes two straps positioned between a lower bottom portion of the extension and the hood, the extension tied by the straps into an approximately columnar shape.

3. The head covering of claim 1, wherein the extension of the head covering has a wide flat shape.

4. The head covering of claim 1, wherein the head covering includes two straps and one strap is tied around the extension and one strap is untied and selectively employed in an untied position as a fashionable accessory.

5. The head covering of claim 1, wherein the extension has a length and the length of the extension enables the extension to tie into a bun.

6. The head covering of claim 5, wherein the bun is held in position by at least one of the straps, the ties or the tying of the extension to itself.

7. The head covering of claim 1, wherein the flap includes connectors, the connectors positioned for the flap to be selectively movable between the closed position that is adapted to retain the hair of the wearer in the pouch and the second position wherein the hair of the wearer passes at least partially through the second aperture.

8. A head covering adapted to be worn on a head of a wearer, the head covering comprises:

a hooded cap that includes a pair of ties, the hooded cap adapted to be secured to the head of the wearer using ties;

an extension that connects to the hooded cap on one end and includes an opposing distal end portion that includes a free terminal end, the distal end portion includes a flap, the extension structured to be selectively arranged in the shape of a column, a wide flat shape and tied into a bun;

a pouch connected to an inwardly directed surface of the extension, the pouch and extension define a first aperture in proximity to the hooded cap and a second aperture in proximity to the terminal end portion of the extension, a passageway defined between the inwardly directed surface of the extension and the pouch;

a plurality of connectors positioned on the flap and the pouch, the flap movable between an open position for the second aperture and a closed position for the second aperture, the connectors positioned for the adjustable positioning of the flap onto the pouch and securing of the flap and pouch together to close the second aperture; and at least one strap connected to the extension, the strap constructed for securing the extension.

9. The head covering of claim 8, wherein the second of the extension includes at least one of the straps loosely tied around the extension, the loosely tied straps facilitating a flat wide shape of the extension.

10. The head covering of claim 8, wherein the bun is attached to the hooded cap using the ties.

11. The head covering of claim 8, wherein the bun is attached to the hooded cap using the straps.

12. The head covering of claim 8, wherein the bun is attached in proximity to the hooded cap by tying itself into the bun.

13. The head covering of claim 8, wherein the extension includes at least two straps and the extension is tied in position using a single strap, the straps in any one of the positions can be left untied to make an alternative fashion statement.

14. The head covering of claim 8, wherein the pouch is selectively positionable between the closed position of the second aperture that is adapted to retain the hair of the wearer and the open position of the second aperture that is adapted to pass through a portion of the hair of the wearer.

* * * * *